US010486780B2

(12) United States Patent
Yeh et al.

(10) Patent No.: US 10,486,780 B2
(45) Date of Patent: Nov. 26, 2019

(54) WATER SPORTS BOARD WITH FOLDABLE SEAT BACK

(71) Applicant: AGIT GLOBAL IP HOLDINGS, LLC, Irvine, CA (US)

(72) Inventors: Tzong In Yeh, Irvine, CA (US); Michal Kocner, Taichung (TW)

(73) Assignee: AGIT GLOBAL IP HOLDINGS, LLC, Irvine, CA (US)

( * ) Notice: Subject to any disclaimer, the term of this patent is extended or adjusted under 35 U.S.C. 154(b) by 0 days.

(21) Appl. No.: 15/983,477

(22) Filed: May 18, 2018

(65) Prior Publication Data

US 2019/0248451 A1 Aug. 15, 2019

(30) Foreign Application Priority Data

Feb. 14, 2018 (TW) ..... 107105671 A

(51) Int. Cl.
*B63B 35/85* (2006.01)
*B63B 35/71* (2006.01)

(52) U.S. Cl.
CPC ..... *B63B 35/71* (2013.01); *B63B 2035/715* (2013.01)

(58) Field of Classification Search
CPC ... B63B 35/71; B63B 35/715; B63B 2035/71; B63B 35/79; B63B 2035/79; B63B 2035/7903
USPC ..... 441/65, 72, 74
See application file for complete search history.

(56) References Cited

U.S. PATENT DOCUMENTS 5,127,862 A * 7/1992 Pia ..... B63B 35/7906 114/39.14
8,590,478 B2 * 11/2013 Lipman ..... B63B 35/79 114/347
9,290,245 B2 3/2016 Bishop
10,214,267 B2 * 2/2019 Robertson ..... B63B 35/71

* cited by examiner

*Primary Examiner* — Daniel V Venne
(74) *Attorney, Agent, or Firm* — Muncy, Geissler, Olds & Lowe, P.C.

(57) ABSTRACT

A foldable seat back includes a base, a back plate and a bracket. The base defines a positioning groove therein. The back plate is pivoted on the base, allowing the back plate to be positioned in at least one folded up state and a folded down state. The bracket has one end pivoted on a rear side of the back plate, and the other end releasably engaged in the positioning groove of the base to sustain the back plate in the folded up state.

10 Claims, 12 Drawing Sheets

WATER SPORTS BOARD WITH FOLDABLE SEAT BACK

BACKGROUND OF THE INVENTION

1. Field of the Invention

The present invention relates to a water sports board, and more particularly to a water sports board equipped with a seat back.

2. Description of the Related Art

U.S. Pat. No. 9,290,245 illustrates a traction pad system for use on a stand-up paddleboard contains an integrated seat feature that may be easily raised by the user at any desired time. In this system, a paddleboard mounting pad, a seat, a bracing mechanism, and an adhesive are included. The paddleboard mounting pad contains a seat-receiving hole, a first surface, and a second surface. The adhesive is superimposed over the second surface and is used to fasten the system to the top of a paddleboard. The seat fits inside the seat-receiving hole in a flush manner and is hingedly attached to the paddleboard mounting pad. The seat therefore does not interfere with the operations of the user when not in use. And the seat is structurally supported by the bracing mechanism in the raised state.

SUMMARY OF THE INVENTION

The present invention provides a new water sports board, equipped with a seat back for the board user to relax and rest on when tired, but also the ability for the seat back to collapse and allow the user full functional use of the water sports board as intended originally.

Briefly described, the water sports board of this invention includes a board body and a foldable seat back embedded in a top surface of the board body. The foldable seat back generally includes a base, a back plate and a bracket. The base defines a positioning groove therein. The back plate is pivoted on the base, allowing the back plate to be positioned in at least one folded up state and a folded down state. The bracket has one end pivoted on a rear side of the back plate, and the other end releasably engaged in the positioning groove of the base to sustain the back plate in the folded up state.

Preferred embodiments of the invention may have the following additional characteristics, either alone or in combination:

Preferably, the bracket includes a pivot pin, a support bar and a linking bar. The pivot pin is arranged on a rear side of the back plate in a horizontal direction. The support bar has opposite first and second ends. The linking bar has one end pivotally connected to the pivot pin, and the other end pivotally connected to the first end of the support bar. The second end of the support bar is engaged in the positioning groove of the base to maintain the back plate in the folded up state.

Preferably, the back plate has two positioning notches located at its rear side thereof and respectively situated at upper and lower sides of the pivot pin, permitting the first end of the support bar to be engaged in a selective one of the positioning notches in order to have the back plate be positioned in the folded up state. In this way, when the second end of the support bar is nested in the positioning groove of the base, engagement of the first end of the support bar in the selected positioning notch in the back plate enables the back plate to be held at a first tilted angle, and engagement of the first end of the support bar in the other positioning notch in the back plate enables the back plate to be held at a second tilted angle different from the first tilted angle.

Preferably, the water sports board further includes a pair of pedals arranged on a top surface of the board body, and a plurality of pairs of ports defined in the top surface of the board body and along a longitudinal axis of the board body. The pedals are provided to be inserted in a selected one pair of the ports so as to adjust a distance between the pedals and the foldable seat back.

The foregoing and other objectives, features, and advantages of the invention will be more readily understood upon consideration of the following detailed description of the invention, taken in conjunction with the accompanying drawings.

DETAILED DESCRIPTION OF EMBODIMENTS

Figure 1:
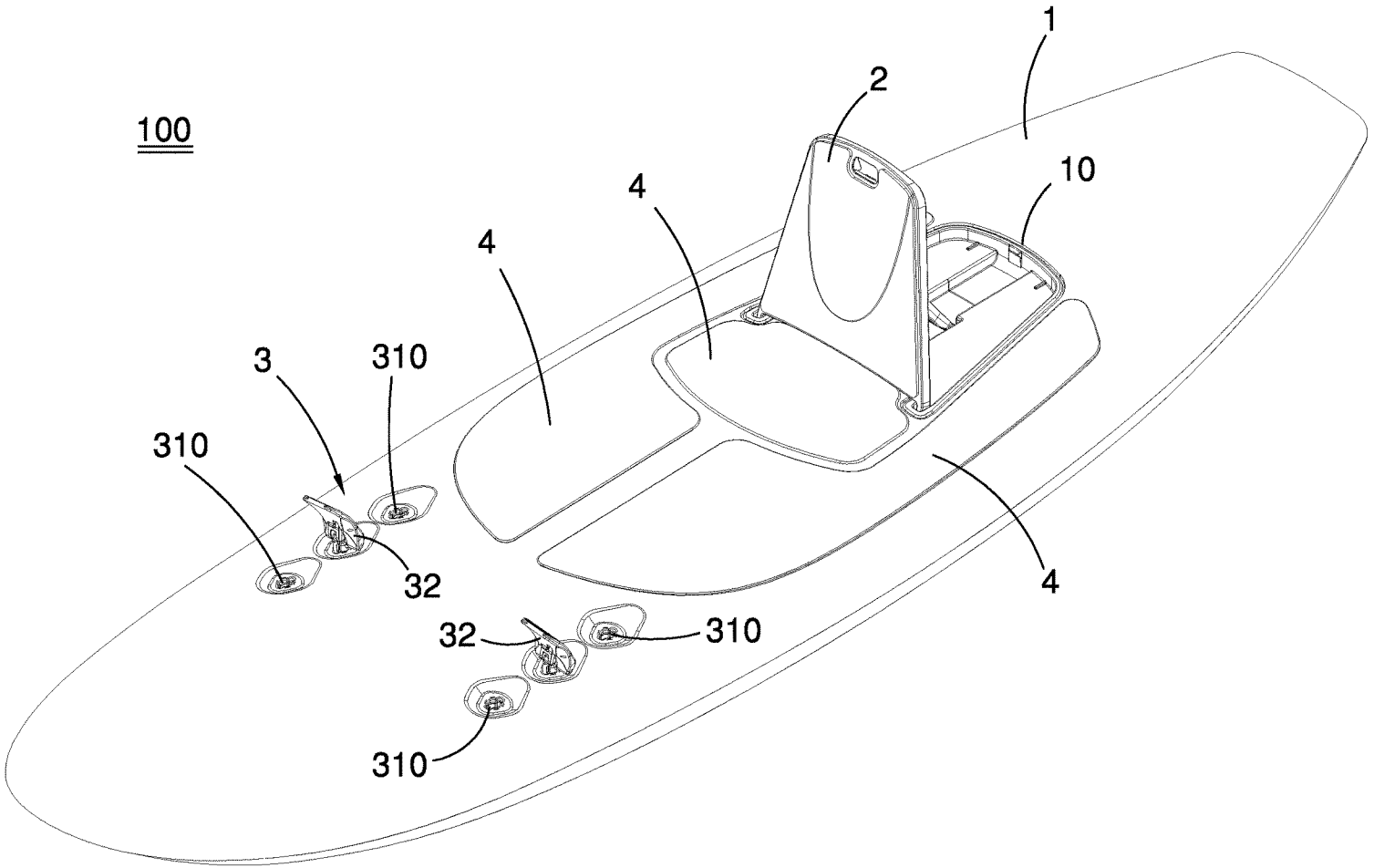
FIG. 1 is a perspective view of a water sports board in accordance with a first embodiment of the present invention, showing that a foldable seat back of the water sports board is in a raised state.
Figure 2:
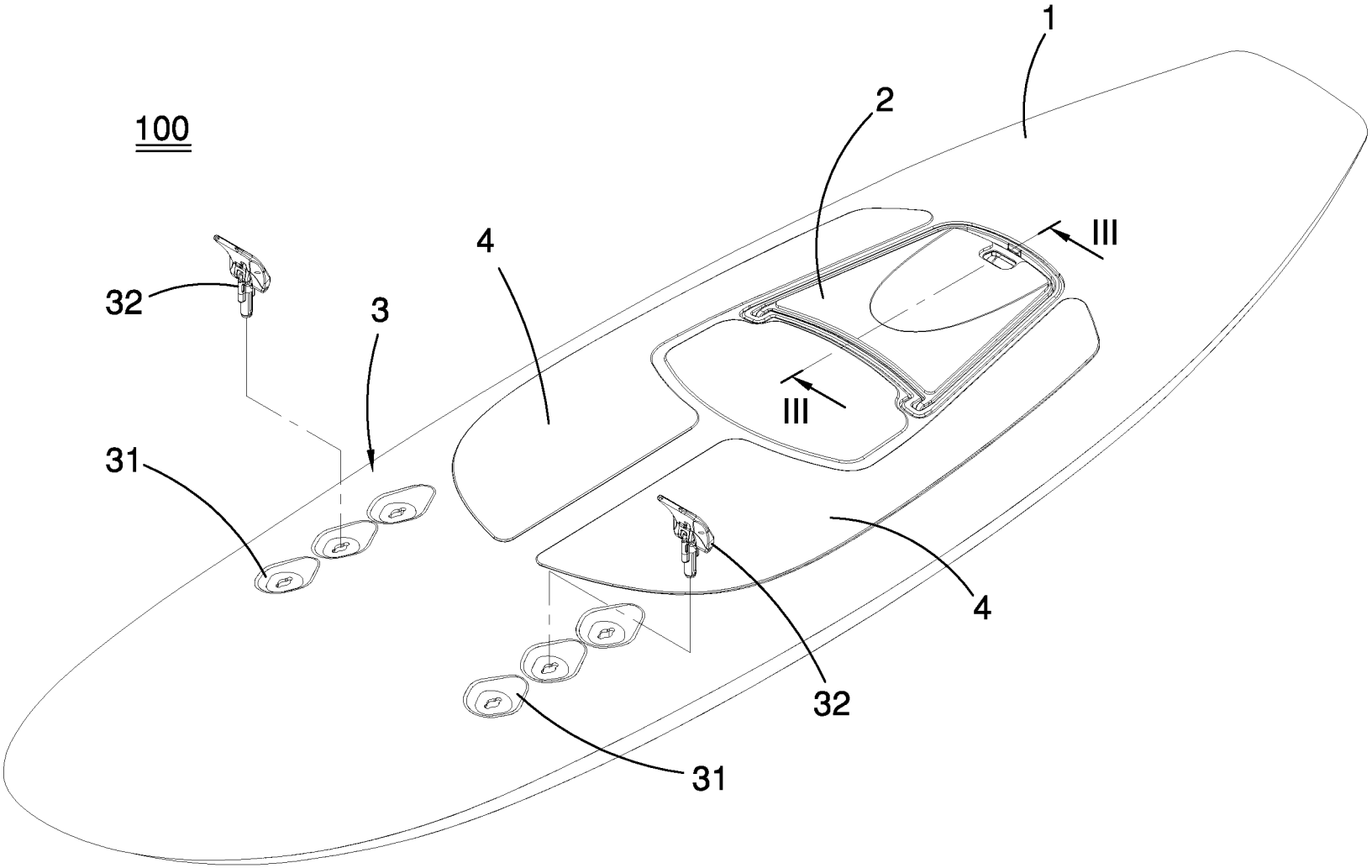
FIG. 2 is another perspective view of the water sports board in FIG. 1, showing that the foldable seat back is in a collapsed state.
Figure 3:
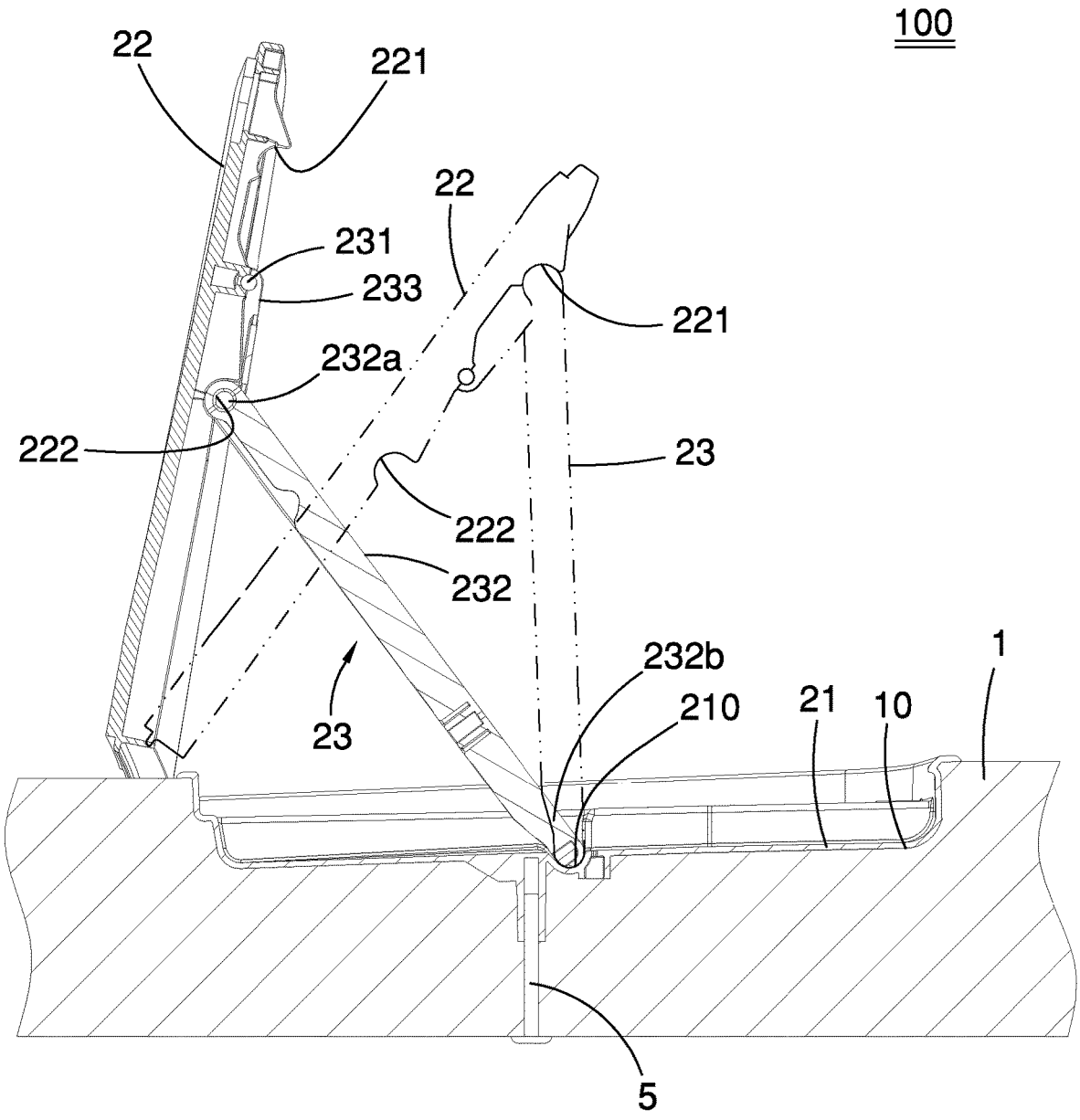
FIG. 3 is a partial enlarged cross-sectional view of the water sports board in FIG. 1, taken along the line of FIG. 2.

Referring to FIGS. 1-3, there is shown a preferred embodiment of the water sports board 100, comprising a board body 1, a foldable seat back 2 embedded on top of the board body 1, a pedal assembly 3 arranged at the front section of the board body 1, and a plurality of traction pads 4 arranged on the board body 1 and around the foldable seat back 2.

Referring to FIGS. 1 and 3, the board body 1 defines a recess 10 in a top surface thereof. The foldable seat back 2 is secured to the board body 1 with a base 21 being embedded in the recess 10 of the board body 1 and engaged with a bolt 5 underneath the board body 1.

FIG. 2 illustrates that the foldable seat back 2 is in a collapsed state, and a pair of pedals 32 of the pedal assembly 3 are detached from the board body 2. In this manner, the top surface of the body board 1 is generally flat and allows the board user to stand on for full functional use of the water sports board as intended originally. On the contrary, when the board user wants to sit down on the body board 1 to relax and rest, a back plate 22 of the seat back 2 may be folded up to a raised position with respect to the base 21 (or the board body 1) for the user's back to lean on. At the same time, The board user may also comfortably rest his or her feet against the pedals 32 of the pedal assembly 3.

Figure 4:
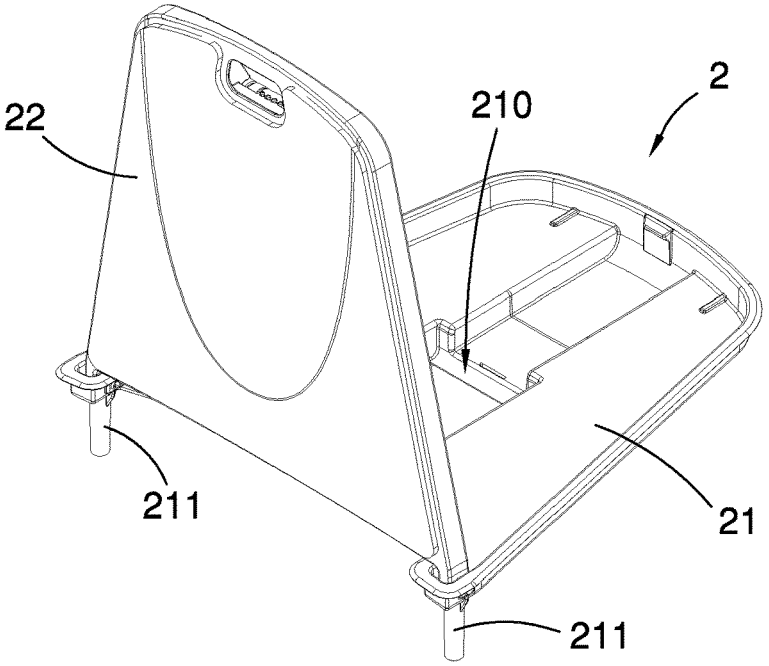
FIG. 4 is a front perspective view of the foldable seat back, showing a back plate of the foldable seat back is raised upright.
Figure 5:
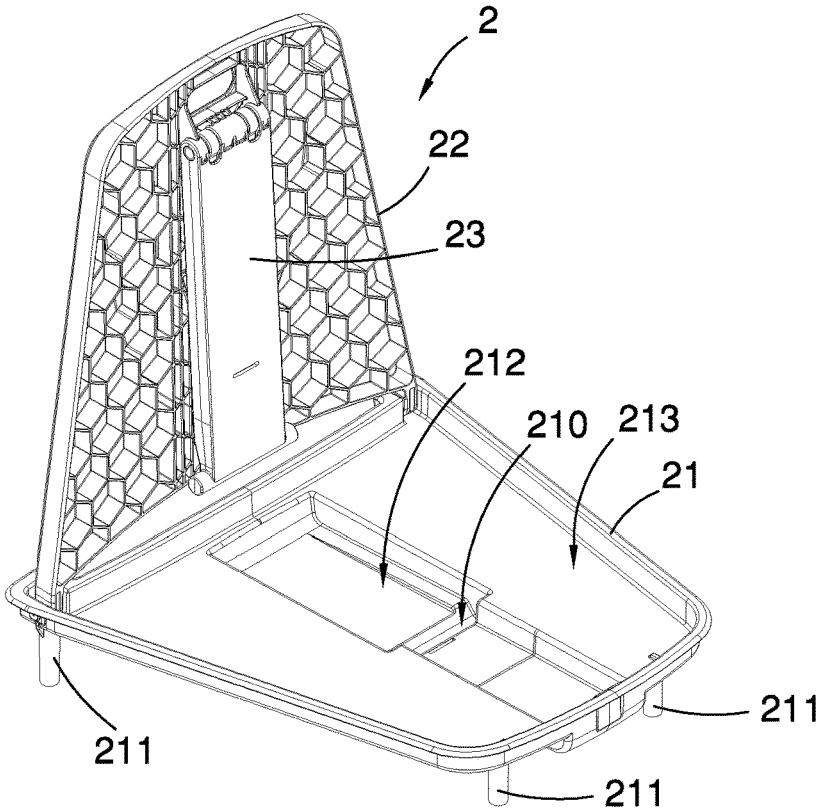
FIG. 5 is a rear perspective view of the foldable seat back shown in FIG. 4.
Figure 9:
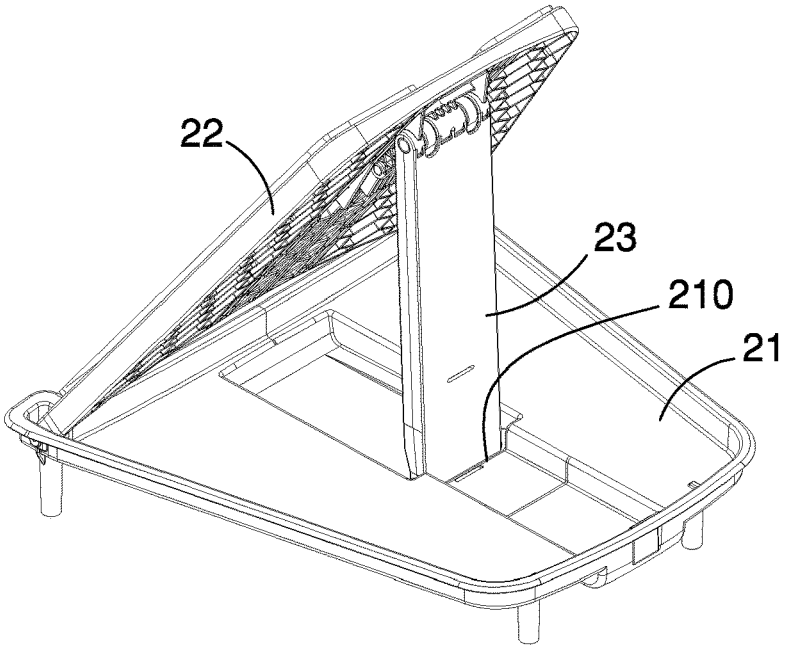
FIG. 9 is a rear perspective view of the foldable seat back, showing the back plate standing at a first tilted angle.

Referring to FIGS. 4, 5 and 9, the foldable seat back 2 generally includes the base 21, the back plate 22 and a bracket 23 for the backing of the back plate 22. The base 21 has a compartment 213 defined therein for accommodation of the back plate 22, an indentation 212 defined in a bottom of the compartment 213 for accommodation of the support bar 23, and a positioning groove 210 defined in a bottom of the indentation 212. Furthermore, the base 21 is formed with a plurality of legs 211 underneath for connection with the board body 1. The back plate 22 is pivoted on a front edge of the base 21, allowing the back plate 22 to be positioned in at least one folded up state and a folded down state. As shown in FIG. 3 or 9, the bracket 23 has one end pivoted on a rear side of the back plate 22, and the other end releasably engaged in the positioning groove 210 of the base 21 to sustain the back plate 22 in the folded up state.

Figure 6:
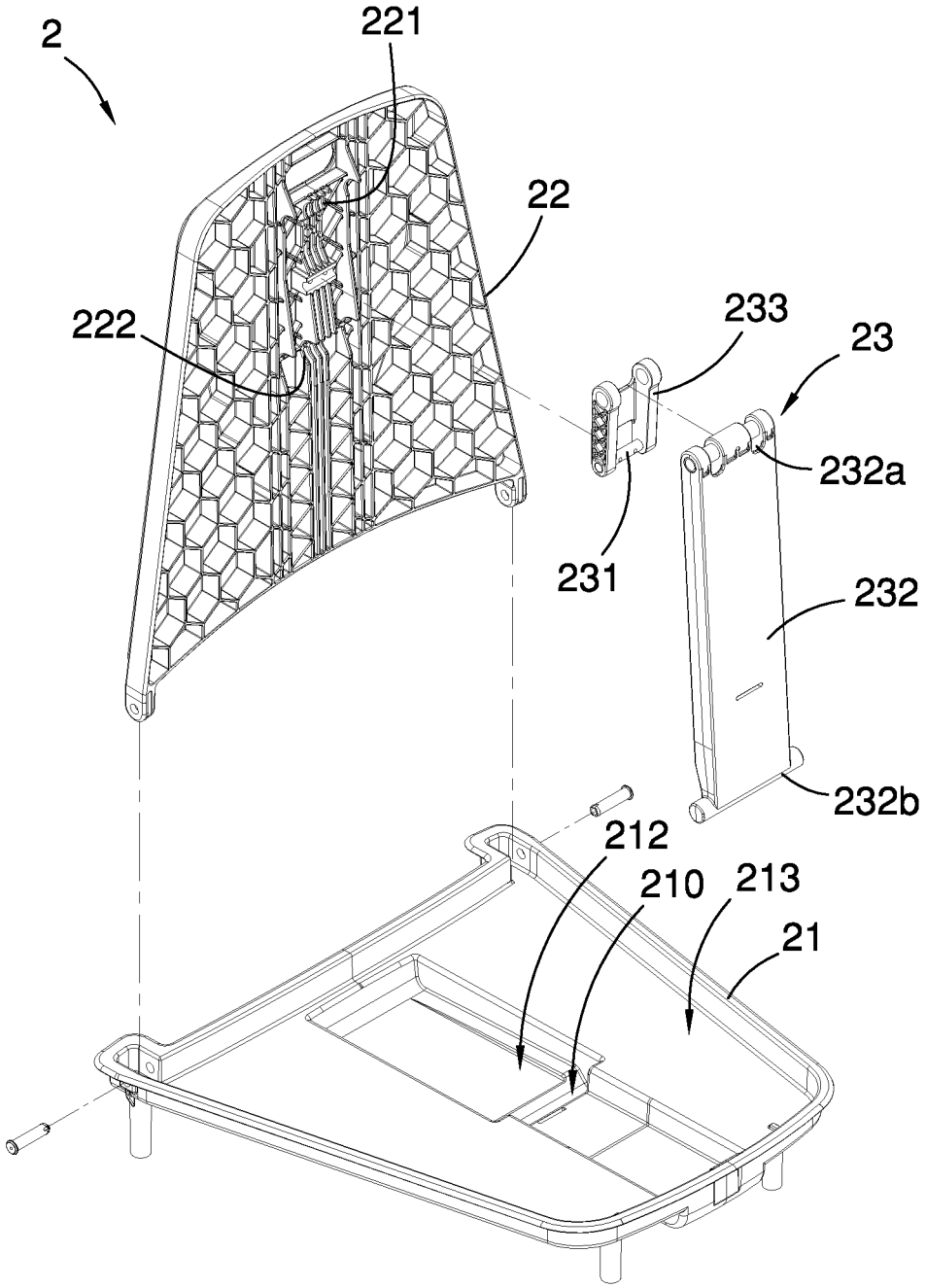
FIG. 6 is an exploded perspective view of the foldable seat back shown in FIG. 5.
Figure 11:
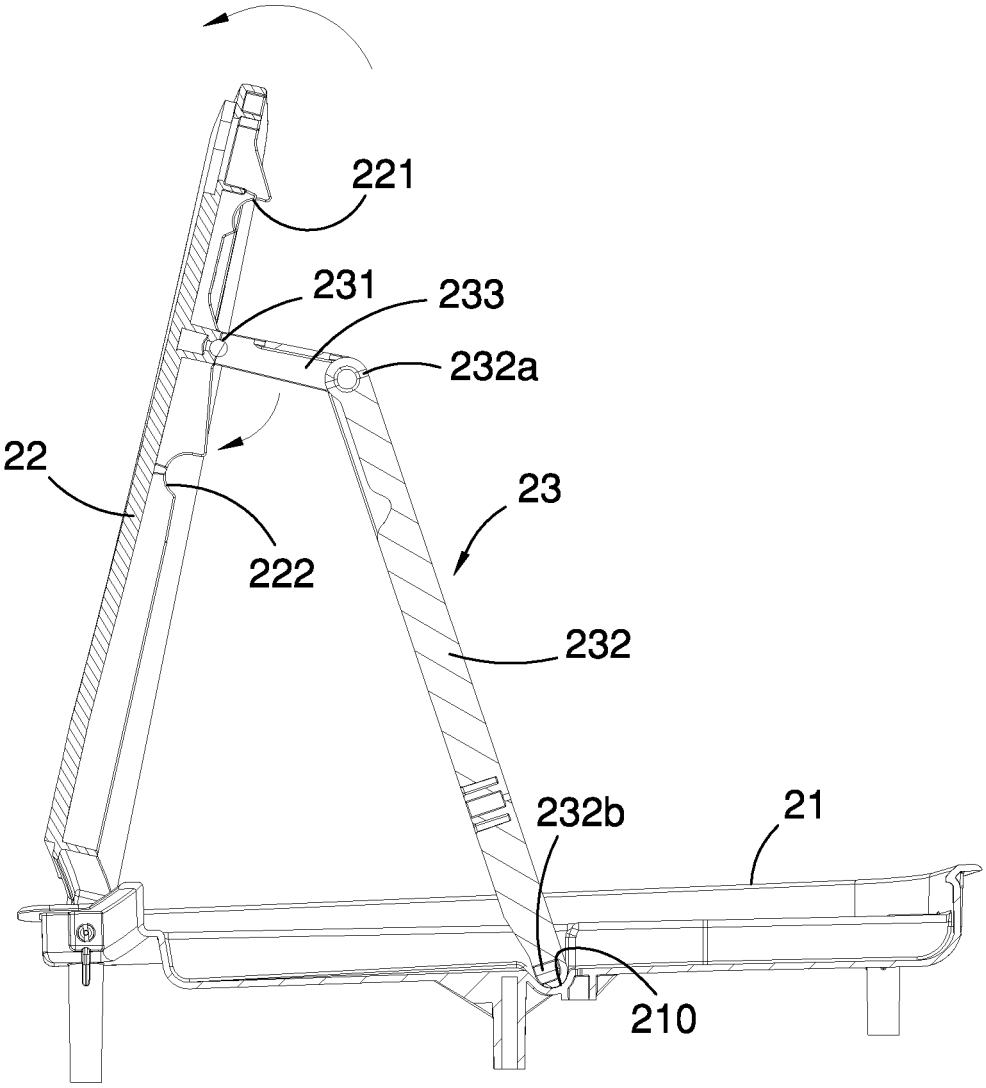
FIG. 11 is a cross-sectional view of the foldable seat back, showing a bracket of the foldable seat back is in transition.
Figure 12:
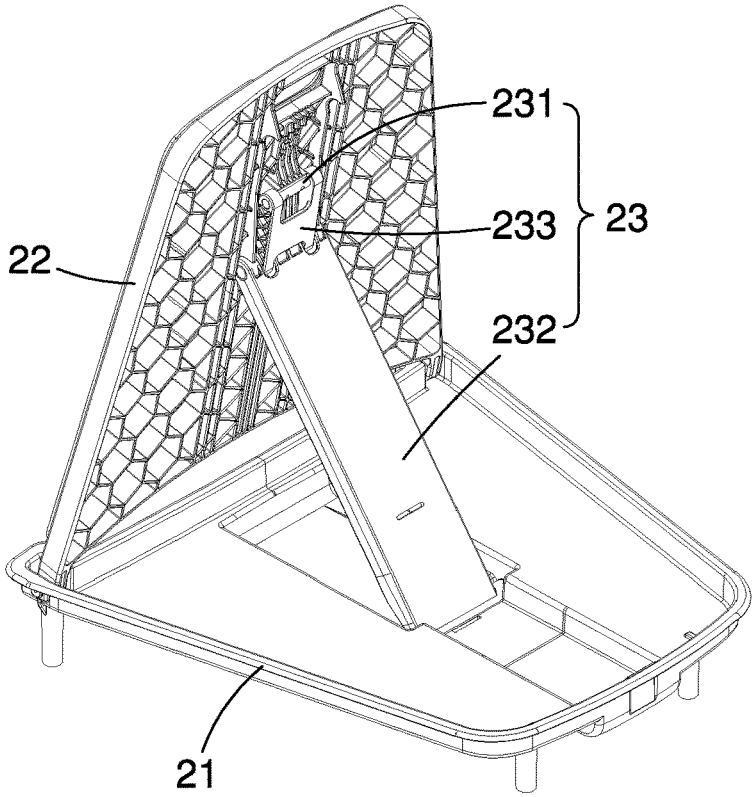
FIG. 12 is a rear perspective view of the foldable seat back, showing the back plate standing at a second tilted angle.

Referring to FIG. 6, the bracket 23 includes a pivot pin 231, a support bar 232 and a linking bar 233. The pivot pin 231 is arranged on the rear side of the back plate 22 in a horizontal direction, as best seen in FIG. 12. The support bar 232 has a first end 232*a* and a second end 232*b* opposite to each other. Referring to FIG. 11, the linking bar 233 has one end pivotally connected to the pivot pin 231, and the other end pivotally connected to the first end 232*a* of the support bar 232. Referring back to FIG. 3, the second end 232*b* of the support bar 232 is releasably engaged in the positioning groove 210 of the base 21 to maintain the back plate 22 in the folded up state(s).

With particular reference to FIGS. 6 and 11, the back plate 22 has two positioning notches 221, 222 located at its rear side and respectively situated at upper and lower sides of the pivot pin 231, permitting the first end 232*a* of the support bar 232 to be engaged in a selective one of the positioning notches 221, 222, thereby retaining the back plate 22 in the folded up state. More specifically, when the second end 232*b* of the support bar 232 is nested in the positioning groove 210 of the base 21, engagement of the first end 232*a* of the support bar 232 in the selected positioning notch 222 in the back plate 22 enables the back plate 22 to be held at a first tilted angle, as depicted by the solid lines in FIG. 3. Likewise, engagement of the first end 232*a* of the support bar 232 in the other positioning notch 221 in the back plate 22 enables the back plate 22 to be held at a second tilted angle, as depicted in the dotted lines in FIG. 3, which is different from the first tilted angle.

Figure 10:
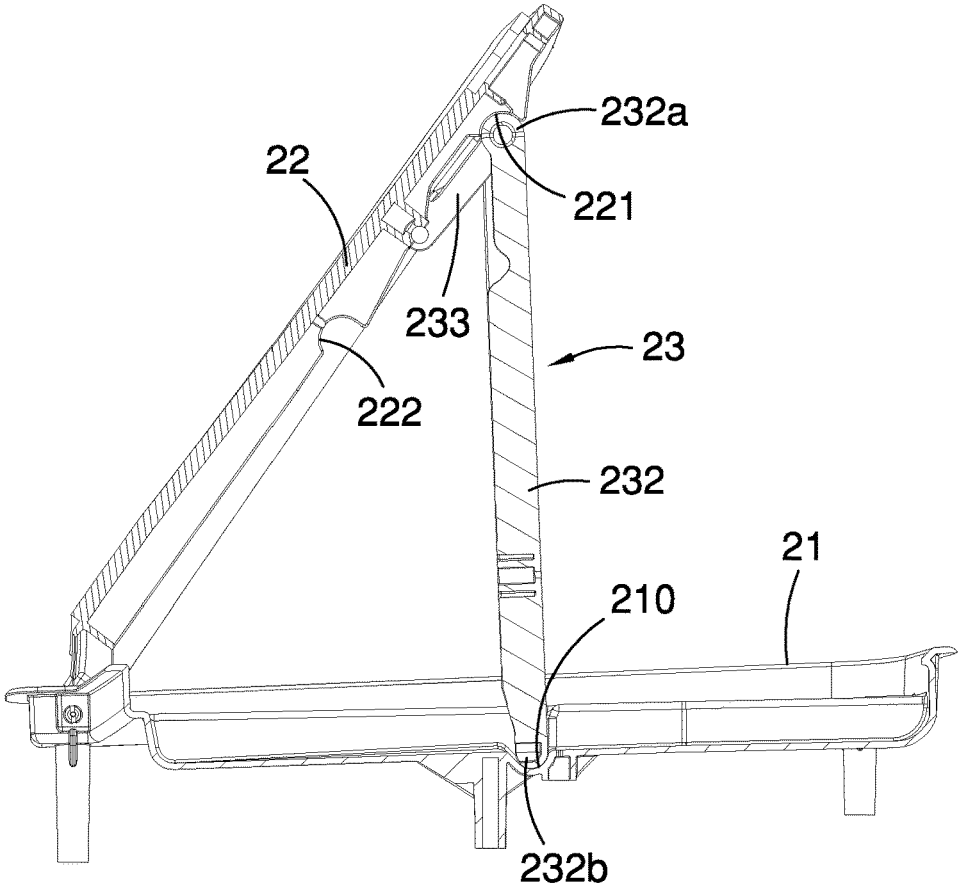
FIG. 10 is a cross-sectional view of the foldable seat back shown in FIG. 9.
Figure 13:
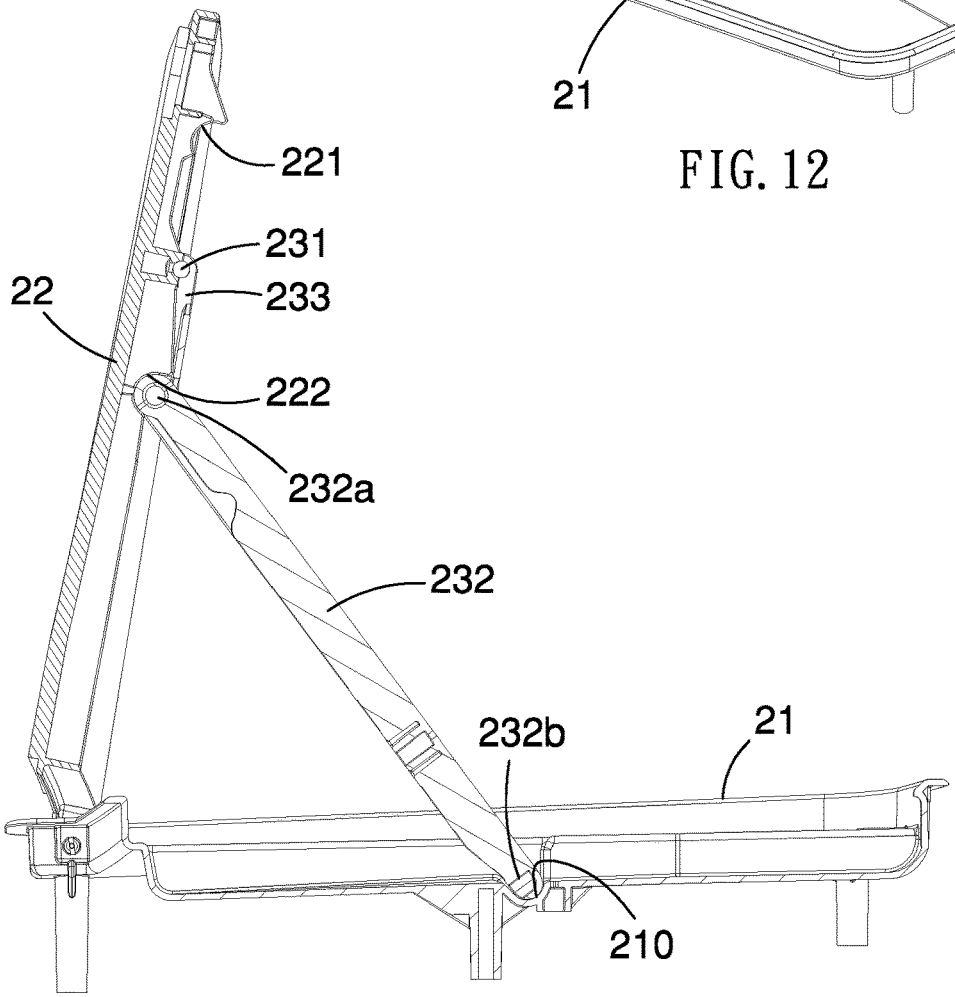
FIG. 13 is a cross-sectional view of the foldable seat back shown in FIG. 12.

As shown in FIGS. 9 and 10, the first end 232*a* of the support bar 232 is engaged in the upper, positioning notch 221 in the back plate 22 and the second end 232*b* of the support bar 232 is engaged in the positioning groove 210 in the base 21 so that the base plate 22 is well held at the second tilted angle, as mentioned earlier. To be shifted from the second tile angle to the first tiled angle, the back plate 22 may be drawn up a bit more with respect to the base 21, as indicated by the arrow in FIG. 11, to have the first end 232*a* of the support bar 232 be detached from the positioning notch 221 of the back plate 22. In the meanwhile, the linking bar 233 is driven to swing about the pivot pin 231 to fit the first end 232*a* of the support bar 232 snugly into the positioning notch 222 in the back plate 22, as depicted in FIGS. 12 and 13, allowing the back plate 22 to stand at the first tilted angle.

Figure 7:
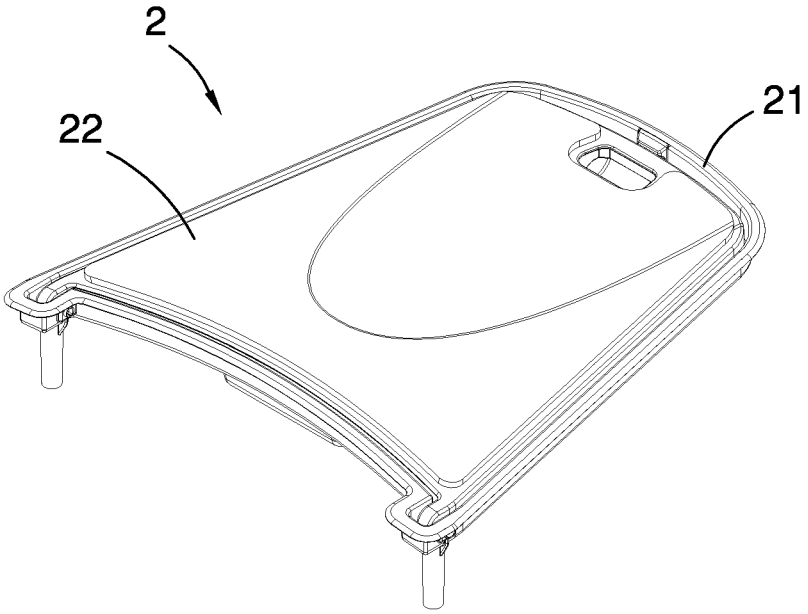
FIG. 7 is a perspective view of the foldable seat back, showing the back plate is in a folded down state.
Figure 8:
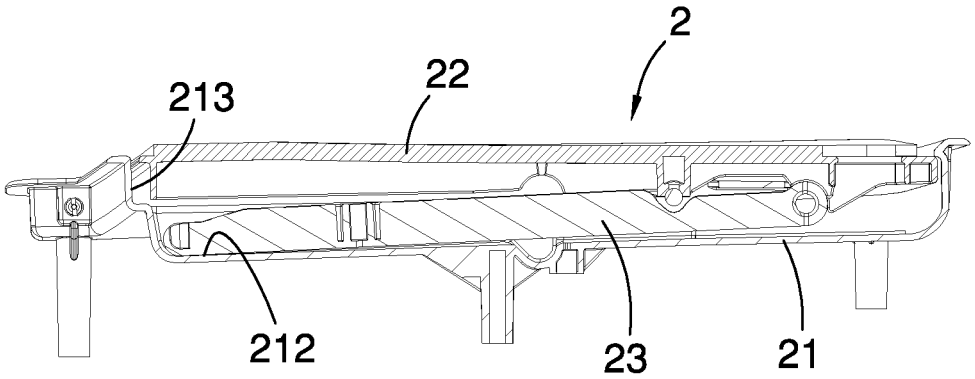
FIG. 8 is a cross-sectional view of the foldable seat back shown in FIG. 7.

As described above, the foldable seat back 2 may be positioned in a collapsed state where the back plate 22 and the bracket 23 of the seat back 2 are respectively contained in the compartment 213 and the indentation 212 in the base 21, as shown in FIG. 7 or 8. This enables the foldable seat back 2 be substantially hidden in the board body 1 and aligned with the top surface of the board body 1 in a flush manner. Moreover, because of the two positioning notches 221, 222 in the rear side of the back plate 22, the back plate 22 of the foldable seat back 2 may be positioned in either one of the first and second tilted angles, as desired.

Figure 14:
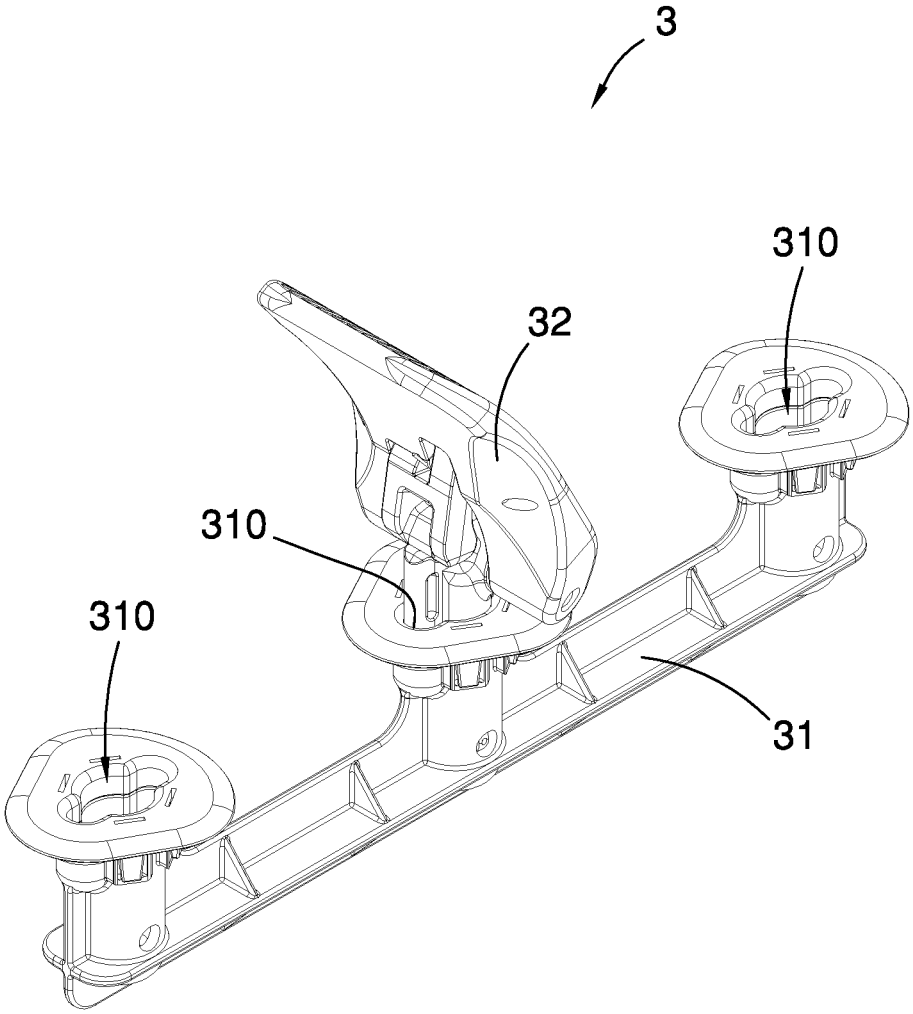
FIG. 14 is a perspective view of a pedal assembly of the foldable seat back shown in FIG. 1.

Referring to FIG. 14 and further in view of FIG. 1, the pedal assembly 3 includes a pair of sockets 31 and the pair of pedals 32. The pair of sockets 31 is embedded in the top surface of the board body 1. Each socket 31 has a plurality of ports 310 exposed from the top surface of the board body 1. In other words, there are pairs of ports 310 arranged along a longitudinal axis of the board body 1. Each of the pedals 32 may be inserted in a selected one of the ports 310 in the socket 31 so as to adjust the distance between the pedal 32 and the foldable seat back 2. In particular, when the pedal 32 is inserted in the respective port 310 in the socket 31, the pedal 32 may further be adjusted to either a raised position (FIG. 18) or a flat position (FIG. 16), as desired.

Figure 15:
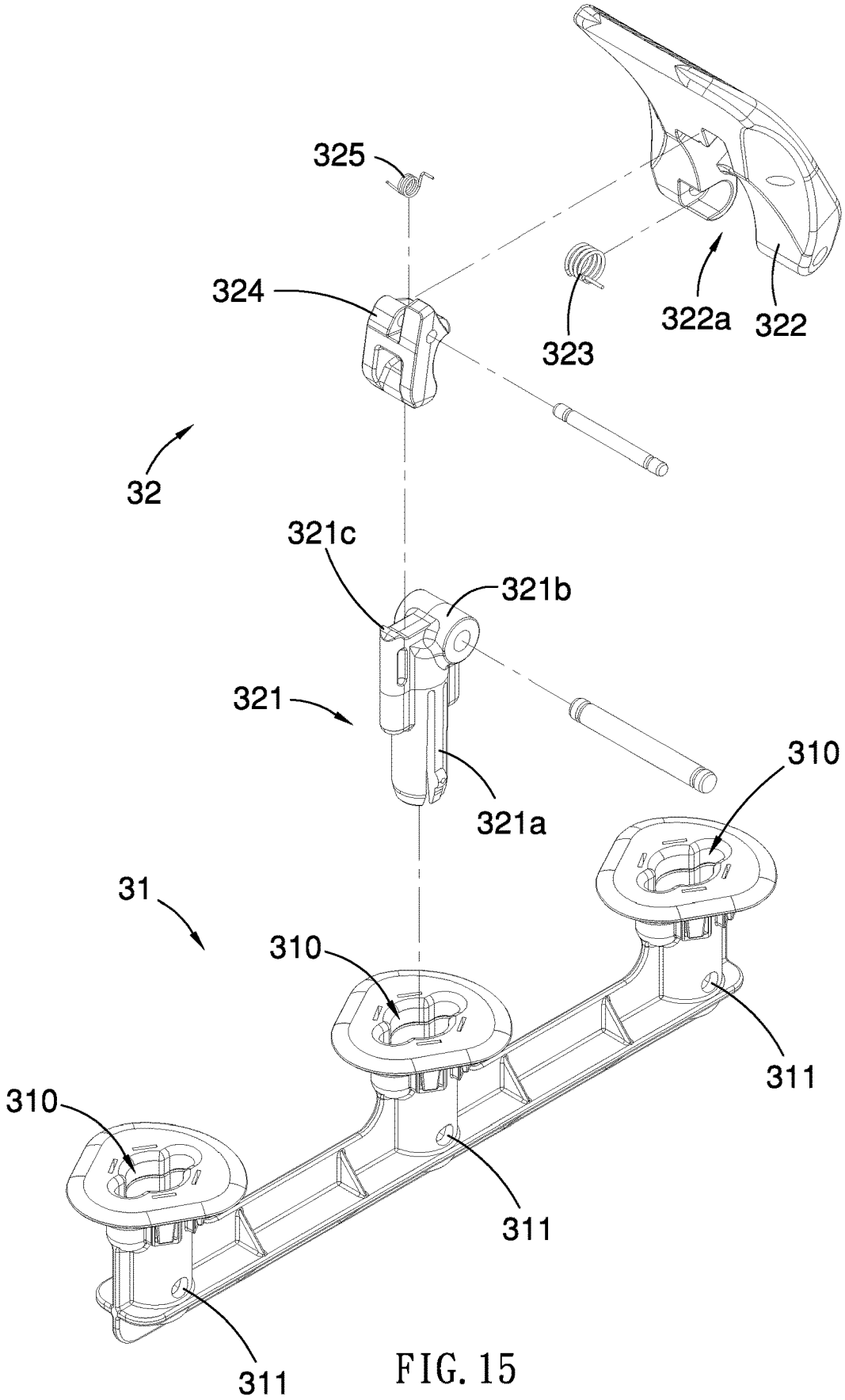
FIG. 15 is an exploded perspective view of the pedal assembly shown in FIG. 14.
Figure 16:
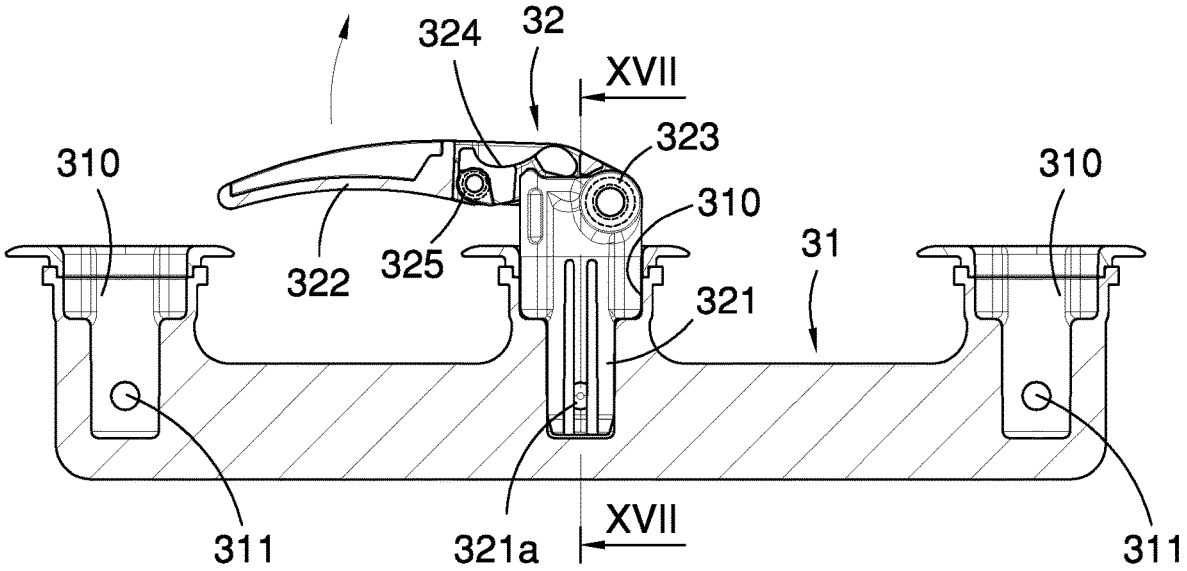
FIG. 16 is a cross-sectional view of the pedal assembly shown in FIG. 14, showing a pedal of the pedal assembly is in a flat position.
Figure 17:
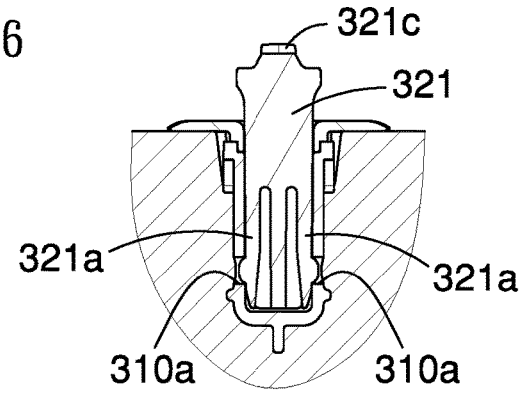
FIG. 17 is a cross-sectional view, taken along the line XVII-XVII of FIG. 16.
Figure 18:
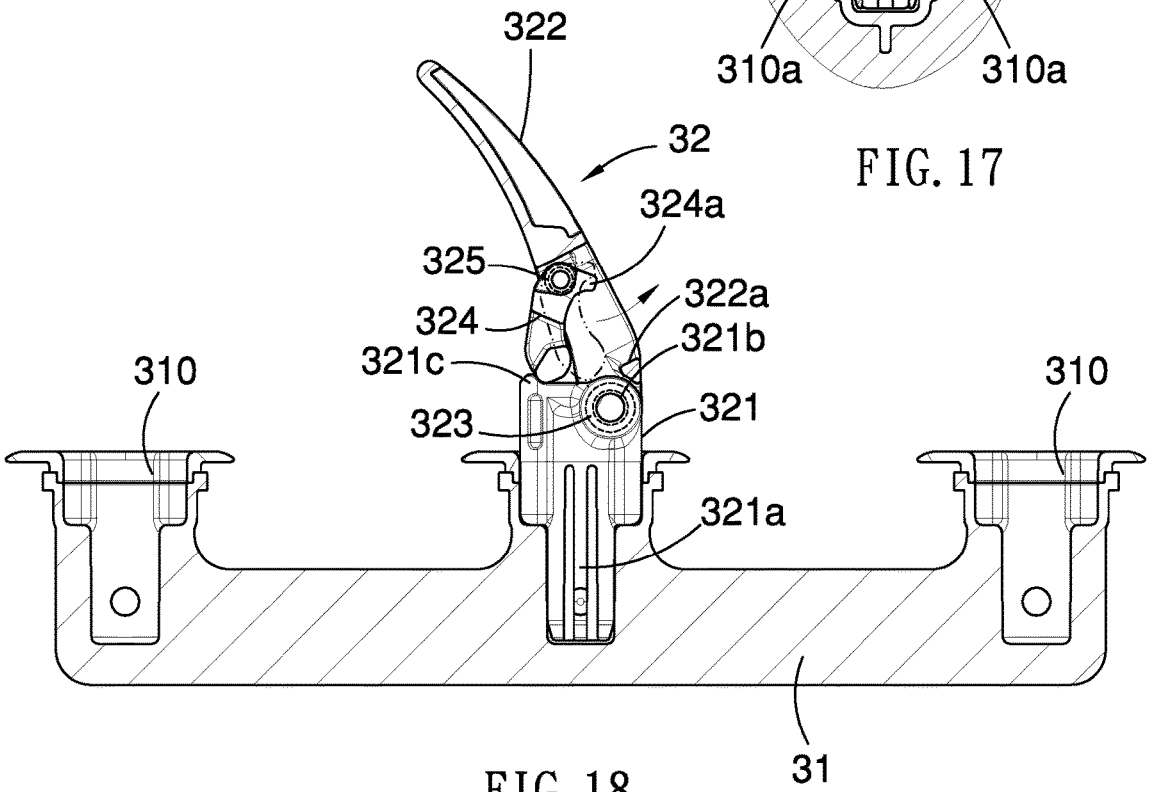
FIG. 18 is a cross-sectional view of the pedal assembly shown in FIG. 14, showing the pedal is in a raised position.

In practice, as best seen in FIG. 15, each of the pedals 32 includes a shank 321, a pedal portion 322, a first torsion spring 323, a movable strut 324, and a second torsion spring 325. The shank 321 has one end formed with a pair of elastic legs 321*a* to be inserted in the respective port 310 in the socket 31, and the other end formed with a pivoting portion 321*b* and a protrusion 321*c* adjacent to each other. The pedal portion 322 has one end being pivoted on the pivoting portion 321*a* of the shank 321 and defining a cave 322*a* therein. As shown in FIG. 16 or 18, the first torsion spring 323 is interposed between the shank 321 and the pedal portion 322. The movable strut 324 has one end pivotably disposed in the cave 322*a* of the pedal portion 322. The second torsion spring 325 is interposed between the pedal portion 322 and the movable strut 324. As shown in FIG. 17, it is noted that when the elastic legs 321*a* of the shank 321 of the pedal 32 are inserted in the respective port 310 of the socket 31, a pair of positioning bumps (not numbered) formed on the pair of the elastic legs 321*a* will be fit snugly into positioning holes 310*a* defined in the inner wall of the port 310.

As described above, when the pedal 32 are in the flat position, the movable strut 324 is seated in the cave 322*a* of the pedal portion 322 and presses the second torsion spring 325 to create a restoring force, as shown in FIG. 16. For use, the pedal 32 may be shifted from the flat position to the raised position as indicated by the arrow in FIG. 16. In this case, the first torsion spring 323 is pressed to create a restoring force, and the other end of the movable strut 324 is pushed out of the cave 322*a* of the pedal portion 322 to the protrusion 321*c* of the shank 321 by the restoring force of the second torsion spring 325, whereby the pedal portion 322 is well supported by the movable strut 324, as shown in FIG. 18. When not in use, the pedal 32 may also be returned from the raised position (FIG. 18) to the flat position (FIG. 16) by pushing up a projected portion 324*a* of the movable strut 324, as indicated by the arrow in FIG. 18, to force the movable strut 324 to move back to the cave 322*a* of the pedal portion 322. And following that, the pedal portion 322 will be pushed back to its flat position by the restoring force of the first torsion spring 323 automatically.

It should be evident that this disclosure is by way of example and that various changes may be made by adding, modifying or eliminating details without departing from the fair scope of the teaching contained in this disclosure.

What is claimed is:

1. A water sports board comprising:

a board body having a top surface; and a foldable seat back, wherein the foldable seat back comprise:

a base secured to the top surface of the board body;

a back plate pivoted on the base, allowing the back plate to be positioned in at least one folded up state and a folded down state, wherein a front side of the back plate is for a person to lean against in the folded up state; in the folded down state, a rear side of the back plate is facing towards a surface of the base and the front side of the back plate is facing upward; and a bracket mounted between the base and the back plate, wherein one end of the bracket is against the rear side of the back plate and the other end is against the surface of the base in the folded up state, and the bracket is sandwiched between the base and the back plate in the folded down state.

2. The water sports board as recited in claim 1, further comprising a pair of pedals arranged on the top surface of the board body, and a plurality of pairs of ports defined in the top surface of the board body and along a longitudinal axis of the board body, wherein the pedals are provided to be inserted in a selected one pair of the ports for adjusting a distance between the pedals and the foldable seat back.

3. The water sports board as recited in claim 2, further comprising a pair of sockets embedded in the top surface of the board body, wherein the pairs of the ports are defined in the sockets respectively.

4. The water sports board as recited in claim 3, wherein when the pedals are inserted in the respective ports in the sockets, the pedals are adjustable to be positioned in raised and flat positions.

5. The water sports board as recited in claim 4, wherein each of the pedals includes a shank, a pedal portion, a first torsion spring, a movable strut, and a second torsion spring; the shank has one end to be inserted in a respective one of the ports in the sockets, and the other end formed with a pivoting portion and a protrusion; the pedal portion has one end being pivoted on the pivoting portion of the shank and defining a cave therein; the first torsion spring is interposed between the shank and the pedal portion; the movable strut has one end pivotably disposed in the cave of the pedal portion; the second torsion spring is interposed between the pedal portion and the movable strut; wherein when the pedal is in the flat position, the movable strut is seated in the cave of the pedal portion and presses the second torsion spring; and when the pedal is moved from the flat position to the raised position, the first torsion spring is pressed, and the other end of the movable strut is pushed out of the cave of the pedal portion to the protrusion of the shank by a restoring force of the second torsion spring.

6. The water sports board as recited in claim 1, further comprising at least one traction pad arranged on the board body.

7. The water sports board as recited in claim 1, wherein the bracket includes a pivot pin, a support bar and a linking bar; the pivot pin is arranged on the rear side of the back plate in a horizontal direction; the support bar has opposite first and second ends; the linking bar has one end pivotally connected to the pivot pin, and the other end pivotally connected to the first end of the support bar; and the second end of the support bar is engaged in a positioning groove of the base to maintain the back plate in the folded up state.

8. The water sports board as recited in claim 7, wherein the back plate has two positioning notches located at its rear side thereof and respectively situated at upper and lower sides of the pivot pin, permitting the first end of the support bar to be engaged in a selective one of the positioning notches in order to have the back plate be positioned in the folded up state; and when the second end of the support bar is nested in the positioning groove of the base, engagement of the first end of the support bar in the selected positioning notch in the back plate enables the back plate to be held at a first tilted angle, and engagement of the first end of the support bar in the other positioning notch in the back plate enables the back plate to be held at a second tilted angle different from the first tilted angle.

9. The water sports board as recited in claim 1, wherein the base further has a compartment defined therein for accommodation of the back plate, and an indentation defined in a bottom of the compartment for accommodation of the support bar; and wherein the positioning groove of the base is defined in a bottom of the indentation.

10. The water sports board as recited in claim 1, wherein the base is formed with a plurality of legs extending downward at a bottom thereof.

* * * * *